US009116493B2

(12) United States Patent
Ishikawa et al.

(10) Patent No.: US 9,116,493 B2
(45) Date of Patent: Aug. 25, 2015

(54) TANDEM TYPE IMAGE FORMING APPARATUS

(71) Applicant: Brother Kogyo Kabushiki Kaisha, Nagoya-shi, Aichi-ken (JP)

(72) Inventors: Satoru Ishikawa, Kitanagoya (JP); Shougo Sato, Seto (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/270,161

(22) Filed: May 5, 2014

(65) Prior Publication Data

US 2014/0241778 A1 Aug. 28, 2014

Related U.S. Application Data

(63) Continuation of application No. 14/052,457, filed on Oct. 11, 2013, now Pat. No. 8,718,514, which is a continuation of application No. 12/489,722, filed on Jun. 23, 2009, now Pat. No. 8,559,850.

(30) Foreign Application Priority Data

Jun. 24, 2008 (JP) ..... 2008-164973

(51) Int. Cl.
*G03G 15/02* (2006.01)
*G03G 15/00* (2006.01)
(Continued)

(52) U.S. Cl.
CPC ..... *G03G 15/6529* (2013.01); *G03G 15/0105* (2013.01); *G03G 15/0121* (2013.01);
(Continued)

(58) Field of Classification Search
CPC ..... G03G 2215/0119; G03G 2221/1684; G03G 15/00; G03G 15/0189; G03G 15/0839; G03G 15/161; G03G 15/2053; G03G 2215/0141; G03G 2215/1661; G03G 2215/2035; G03G 15/0142; G03G 15/0808; G03G 15/0813
See application file for complete search history.

(56) References Cited

U.S. PATENT DOCUMENTS 6,647,227 B2 11/2003 Yokoi et al.
6,996,354 B2 2/2006 Kimura et al.
(Continued)

FOREIGN PATENT DOCUMENTS

CN 1797230 A 7/2006
JP 04-212973 A 8/1992
(Continued)

OTHER PUBLICATIONS

JP Office Action dtd Jul. 13, 2010, JP Appln. 2008-164973, English Translation.
(Continued)

*Primary Examiner* — Roy Y Yi
(74) *Attorney, Agent, or Firm* — Banner & Witcoff, Ltd.

(57) ABSTRACT

To facilitate replacing photosensitive drums and/or developing devices in an image forming apparatus, a photosensitive member unit including a plurality of photosensitive members is loaded in a main casing. A developing device unit including a plurality of developing devices is also loaded in the main casing. Both an intermediate transfer belt and the photosensitive member unit are configured to be movable toward and away from the developing device unit. Further, when the photosensitive member unit is separated from the developing device unit, the intermediate transfer belt and the plurality of photosensitive members are also separated from each other.

12 Claims, 10 Drawing Sheets

(51) Int. Cl.
*G03G 15/01* (2006.01)
*G03G 15/08* (2006.01)

(52) U.S. Cl.
CPC ..... *G03G15/0194* (2013.01); *G03G 15/0889* (2013.01); *G03G 2215/0132* (2013.01); *G03G 2221/1654* (2013.01); *G03G 2221/1684* (2013.01)

(56) References Cited

U.S. PATENT DOCUMENTS

| | | | | |
|---|---|---|---|---|
| 7,031,638 | B2 | 4/2006 | Tanizaki et al. | |
| 7,447,467 | B2 | 11/2008 | Kamimura et al. | |
| 7,720,413 | B2 | 5/2010 | Kamimura et al. | |
| 8,200,120 | B2 * | 6/2012 | Sato | 399/110 |
| 8,559,850 | B2 * | 10/2013 | Ishikawa et al. | 399/116 |
| 8,718,514 | B2 * | 5/2014 | Ishikawa et al. | 399/116 |
| 2005/0047804 | A1 | 3/2005 | Kosuge | |
| 2006/0140673 | A1 | 6/2006 | Kamimura et al. | |
| 2006/0153589 | A1 | 7/2006 | Sato et al. | |
| 2009/0028602 | A1 | 1/2009 | Kamimura et al. | |
| 2010/0209140 | A1 | 8/2010 | Kamimura et al. | |
| 2012/0070191 | A1 | 3/2012 | Im et al. | |
| 2013/0071140 | A1 | 3/2013 | Miyahara et al. | |

FOREIGN PATENT DOCUMENTS

| | | | |
|---|---|---|---|
| JP | 2004-094151 | A | 3/2004 |
| JP | 2005-141277 | A | 6/2005 |
| JP | 2006-184552 | A | 7/2006 |

OTHER PUBLICATIONS

CN Office Action dtd Feb. 25, 2011, CN Appln. 200910151347.5, English translation.

* cited by examiner

TANDEM TYPE IMAGE FORMING APPARATUS

CROSS REFERENCE TO RELATED APPLICATION

This application is a continuation of prior U.S. application Ser. No. 14/052,457, filed Oct. 11, 2013, which is a continuation of prior U.S. application Ser. No. 12/489,722, filed Jun. 23, 2009, which claims priority from Japanese Patent Application No. 2008-164973 filed Jun. 24, 2008. The entire content of the priority applications is incorporated herein by reference.

BACKGROUND OF THE INVENTION

1. Field of the Invention

The present invention relates to a tandem type image forming apparatus including a plurality of photosensitive drums.

2. Description of the Related Art

Image forming apparatuses such as printer, copying machine, include a photosensitive drum and a developing device. In view of the fact that endurance limit or service life is not the same in the photosensitive drum and the developing device, the photosensitive drum and developing unit are individually detachably mounted on the image forming apparatus to enable a user to replace the used photosensitive drum or developing unit with a new one.

Japanese Patent Application Publication No. 2004-94151 discloses a color printer including a plurality of photosensitive drums, a plurality of developing devices, and a transfer belt unit. The photosensitive drums are mounted from the upper portion of the printer and placed on the frame of the transfer belt so as to confront the corresponding developing devices. When one or more developing devices are replaced with new ones, the transfer belt unit is pivotally moved upward to thereby separate the photosensitive drums from the developing devices, and then the developing device is removed.

However, with the configuration disclosed in Japanese Patent Application Publication No. 2004-94151, after separation of the photosensitive drums from the developing devices, almost all part of the photosensitive drum is exposed. Accordingly, attention has to be paid in exchanging the drum so as not to touch the photosensitive drum. Further, the photosensitive drum separated from the developing device still remains in contact with the transfer belt unit. Accordingly, the drum replacing operation has to be performed so as not to damage the photosensitive drum and the transfer belt unit.

SUMMARY OF THE INVENTION

In view of the foregoing, it is an object of the present invention to provide an image forming apparatus with an improved operability in replacing photosensitive drums and/or developing devices.

In order to achieve the above and other objects, there is provided an image forming apparatus that includes a main casing, a belt unit, a photosensitive member unit and a developing device unit. The belt unit is supported by the main casing and includes an endless belt and a plurality of transfer members. The photosensitive member unit includes a plurality of photosensitive members disposed in one-to-one correspondence with the plurality of transfer members. Electrostatic latent images are formable on each photosensitive member. The plurality of photosensitive members is arranged along a line extending in a direction orthogonal to the axial direction of the photosensitive member. The photosensitive member unit is loaded in the main casing. The developing device unit includes a plurality of developing devices disposed in one-to-one correspondence with the plurality of photosensitive members. Each developing device includes a developing member that supplies toner to corresponding photosensitive member to develop the electrostatic latent images formed thereon and provide toner images which are transferred onto the endless belt by corresponding transfer member. The photosensitive member unit is held in contact with the endless belt when the toner images are transferred onto the endless belt. The developing device unit is loaded in the main casing. Both the belt unit and the photosensitive member unit are configured to be movable toward and away from the developing device unit. When the photosensitive member unit is separated from the developing device unit, the belt unit and the plurality of photosensitive members are also separated from each other.

BRIEF DESCRIPTION OF THE DRAWINGS

The particular features and advantages of the invention as well as other objects will become apparent from the following description taken in connection with the accompanying drawings, in which.

DETAILED DESCRIPTION OF THE PREFERRED EMBODIMENTS

A color multifunctional peripheral (hereinafter simply referred to as "color MFP") as one of image forming apparatuses will be described with reference to FIGS. 1 through 10. In the following description, the terms "upward", "downward", "frontward", "rearward", "rightward", "leftward" and the like will be used throughout the description assuming that the color MFP is disposed in an orientation in which it is intended to be used. More specifically, the term "frontward" designates the right side of the color MFP in FIG. 1, while the term "rearward" designates the left side of the color MFP in FIG. 1. Also, the far side in FIG. 1 will be referred to as "rightward" while the near side in FIG. 1 as "leftward". Further, the upside in FIG. 1 will be referred to as "upward" and the downside in FIG. 1 as "downward".

Figure 1:
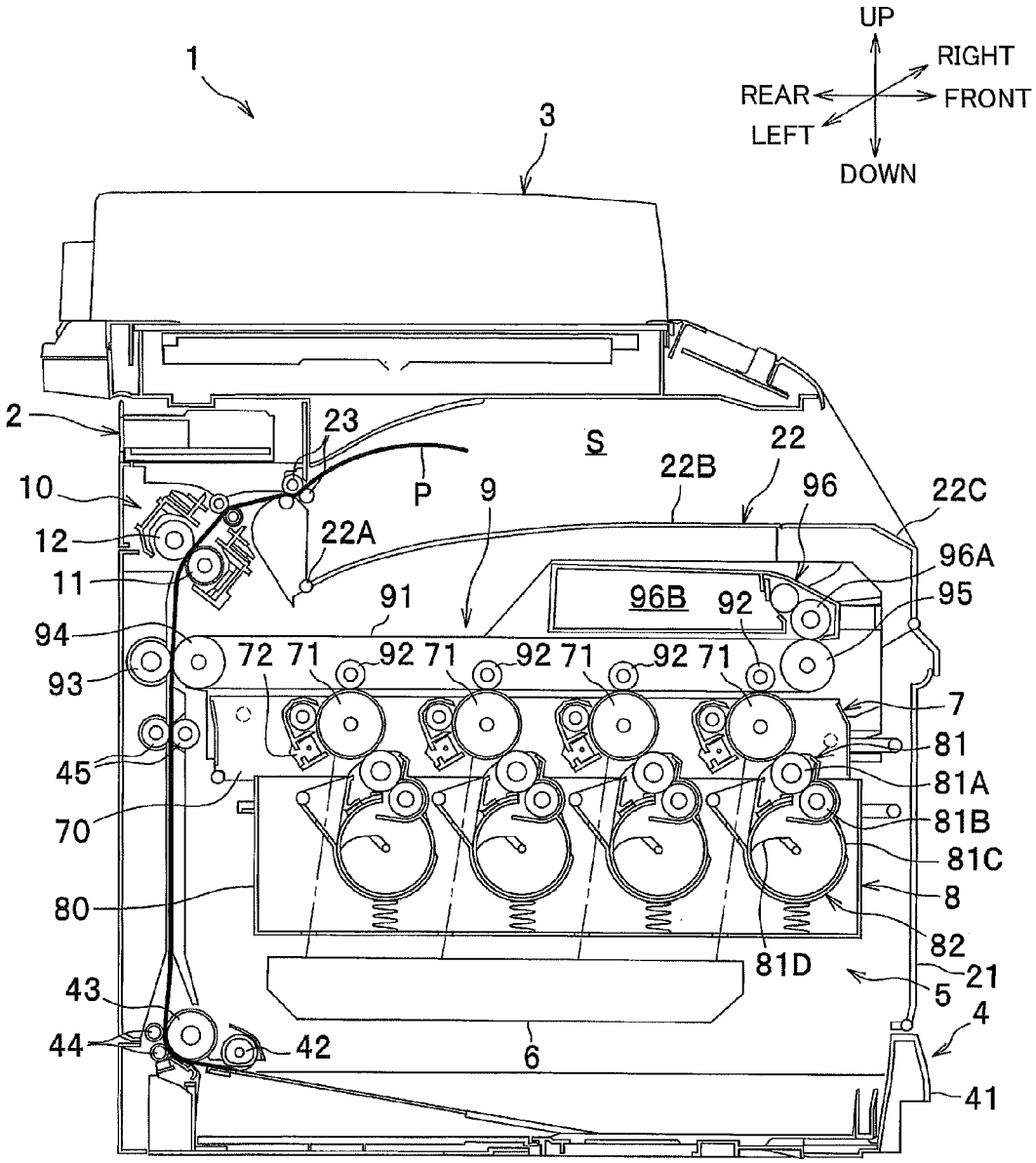
FIG. 1 is a cross-sectional view showing a color multi-function peripheral as one example of image forming apparatuses.

As shown in FIG. 1, the color MFP 1 includes a main casing 2, a flat head scanner 3 disposed above the main casing 2, a sheet feed section 4, and an image forming section 5. The sheet feed section 4 and the image forming section 5 are disposed inside the main casing 2. The sheet feed section 4 feeds sheets of paper (hereinafter simply referred to as "sheet P"), and the image forming section 5 forms images on the sheet P supplied from the sheet feed section 4.

A front cover 21 is provided in the front side of the main casing 2, while an upper cover 22 is provided in the upper portion of the main casing 2. The front cover 21 is pivotally movable in front-to-rear direction about the bottom end thereof. The upper cover 22 has a pivot shaft 22A at the rear end thereof so that the upper cover 22 is pivotally movable about the pivot shaft 22A in the up-to-down direction. A discharge tray 22B is formed in the upper surface of the upper cover 22A. The sheet P discharged out of the main casing 2 is piled in the discharge tray 22B.

The flat head scanner 3 is a well-known conventional image scanning device. The flat head scanner 3 irradiates light onto a sheet P and scans images on the sheet P, and generates image data according to the scanned images. The flat head scanner 3 is provided above the upper cover 22 (the main casing 2) with a space S interposed therebetween. The sheet P is first discharged into the space S from the main casing 2, and is then stacked on the discharge tray 22B.

The sheet feed section 4 is disposed in the bottom portion of the main casing 2. The sheet feed section 4 includes a sheet feed cassette 41, a pick-up roller 42, a separation roller 43, sheet feed rollers 44 and 45. The sheet feed cassette 41 is detachably mounted in the main casing 2 and accommodates sheets P in a stacked state. The pick-up roller 42 is disposed rearward and upward of the sheet feed cassette 41 in the main casing 2. The pick-up roller 42 conveys the sheets P stacked in the sheet feed cassette 41 to the separation roller 43. The separation roller 43 separates the conveyed sheets P one by one. The sheet feed rollers 44 and 45 then convey each sheet P upward to pass between an intermediate transfer belt 91 and a secondary transfer roller 93.

An image forming section 5 includes an exposing unit 6, a photosensitive drum unit 7, a developing device unit 8, a belt unit 9 and a fixing unit 10.

The exposing unit 6 is disposed above the sheet feed section 4. The exposing unit 6 includes a conventional laser generating section, a polygon mirror, a plurality of lenses and a plurality of reflection mirrors, all of which are not shown in the drawings. In the exposing unit 6, the laser generating section generates laser beams corresponding to yellow, cyan, magenta, and black. The laser beam is reflected upon the reflective mirrors and scanned by the polygon mirror, and finally irradiated onto the surface of the relevant photosensitive drum 71 (to be described later) provided in the photosensitive drum unit 7.

The photosensitive drum unit 7 is disposed above the exposing unit 6 and between the developing device unit 8 and the belt unit 9. The photosensitive drum unit 7 includes a drum supporting frame 70, four photosensitive drums 71, and four chargers 72. The drum supporting frame 70 defines an outline of the photosensitive drum unit 7, and the photosensitive drums 71 are juxtaposed within the drum supporting frame 70. The photosensitive drums 71 are juxtaposed in the front-to-rear direction, i.e., along a line extending in a direction orthogonal to the longitudinal axis of the photosensitive drum 71. Each of the chargers is disposed in correspondence with each of the photosensitive drums 71. Detailed configuration of the drum supporting frame 70 will be described later.

The developing device unit 8 is disposed between the exposing unit 6 and the photosensitive drum unit 7. The developing device unit 8 includes a developing device supporting frame 80, four developing devices 81, and four developing device holders 82. The developing device supporting frame 80 constitutes an outer frame of the developing device unit 8. Each of the developing devices 81 is disposed in correspondence with each of the photosensitive drums 71, and detachably mounted in each of the developing device holders 82. Details of the developing device unit 8 will be described later.

Each developing device 81 includes a developing roller 81A, a supply roller 81B, a toner accommodating chamber 81C, and an agitator 81D. The developing roller 81A is disposed in opposition to the corresponding photosensitive drum 71. The supply roller 81B supplies toner (developer) to the developing roller 81A. The toner accommodating chamber 81C accommodates toner therein, and the agitator 81D is rotatably provided within the toner accommodating chamber 81C for agitating toner. In each developing device 81, the agitator 81D is driven to supply toner accommodated in the toner accommodating chamber 81C to the supply roller 81B. Toner is then supplied to the developing roller 81A and thus borne on the surface of the developing roller 81A.

The belt unit 9 is disposed above the photosensitive drum unit 7. The belt unit 9 includes the intermediate transfer belt 91, four primary transfer rollers 92, the secondary transfer roller 93, a drive roller 94, a follow roller 95, and a cleaning section 96.

The intermediate transfer belt 91 is in the form of an endless belt. The drive roller 94 and the follow roller 95 are disposed in spaced-apart relation to each other in the front-to-rear direction. The intermediate transfer belt 91 is stretched around the drive roller 94 and the follow roller 95 and has an outer circumferential surface. Each of the photosensitive drums 71 opposes and contacts the outer circumferential surface of the intermediate transfer belt 91 at the bottom thereof. The secondary transfer roller 93 is disposed in opposition to and in contact with the outer circumferential surface of the intermediate transfer belt 91 at the rear side thereof.

Each of the primary transfer rollers 92 is provided inside the loop of the intermediate transfer belt so as to be in contact with the inner circumferential surface of the intermediate transfer belt 91. Each primary transfer roller 92 is also disposed in opposition to corresponding photosensitive drum 71 so that primary transfer roller 92 and the corresponding photosensitive drum 71 can nip the intermediate transfer belt 91 therebetween. The secondary transfer roller 93 is disposed in opposition to the drive roller 94 so that the intermediate transfer belt 91 can be nipped therebetween. A transfer bias is applied to the primary transfer rollers 92 and the secondary transfer roller 93 during transfer operations.

The cleaning unit 96 is disposed above the intermediate transfer belt 91 at the front side thereof. The cleaning unit 96 includes a cleaning roller 96A and a toner storage section 96B. The cleaning roller 96A cleans the toner remaining on the intermediate transfer belt 91, and the toner storage section 96B stores the removed toner. Note that the cleaning unit 96 is detachably mounted in the color MFP 1 through an opening (not shown) formed when a second front cover 22C provided in the upper cover 22 is opened.

The fixing unit 10 is disposed above the secondary transfer roller 93 and the drive roller 94. The fixing unit 10 includes a heat roller 11 and a pressure roller 12 disposed in opposition to the heat roller 11. The pressure roller 12 applies pressure to the heat roller 11.

In the image forming section 5 with the above-described configuration, each surface of the photosensitive drums 71 is first uniformly charged by the corresponding charger 72, and then exposed to a laser beam emitted from the exposing unit 6. Areas exposed to the laser beam have a lower potential, thereby forming an electrostatic latent image on the surface of each photosensitive drum 71 based on image data.

Toner borne on the surface of the developing roller 81A is supplied to the surface of the photosensitive drum 71 on which the electrostatic latent image is formed. In this way, toner is selectively carried on the surface of the photosensitive drum 71, and the latent image formed thereon is developed into a visible toner image.

The toner images borne on the surfaces of the photosensitive drums 71 are then transferred onto the surface of the intermediate transfer belt 91 so as to be sequentially superimposed one on the other by virtue of the transfer bias applied to the primary transfer rollers 92. The full-color toner images on the surface of the intermediate transfer roller 91 are then transferred onto the sheet P when the sheet P passes between the intermediate transfer belt 91 and the secondary transfer roller 93 to which a transfer bias is applied.

The sheet P on which the full-color toner images are transferred is then conveyed to the fixing unit 10. The toner images are then thermally fixed to the sheet P when the sheet P passes between the heat roller 11 and the pressure roller 12. The sheet P is then discharged into the space S out of the main casing 2 by the discharge rollers 23, and is finally stacked on the discharge tray 22B.

Next, detailed configurations of the belt unit 9, the photosensitive unit 7, and the developing device unit 8 will be described.

<Configuration of Belt Unit>

Figure 2A:
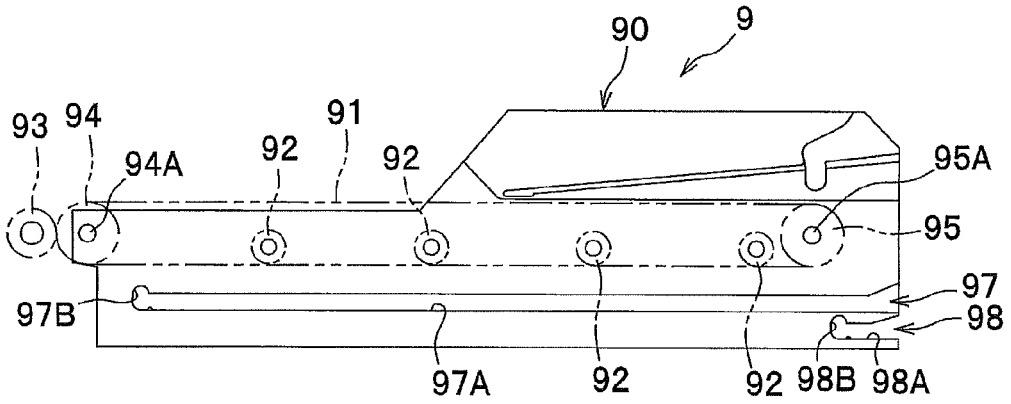
FIG. 2A shows a belt support frame as viewed from an internal side of the color multi-function peripheral.

As shown in FIG. 2A, the belt unit 9 includes a pair of belt support frames 90 in addition to the intermediate transfer belt 91, primary transfer rollers 92, secondary transfer roller 93, drive roller 94, follow roller 95. It should be noted that FIG. 2A shows only a counterpart of the belt support frame 90.

The pair of belt support frames 90 is disposed in confrontation with each other at both widthwise ends of the intermediate transfer belt 91. The direction in which the belt support frames 90 confront is in coincidence with left-to-right direction or the axial direction of the photosensitive drum 71. The pair of belt support frames 90 supports the primary transfer rollers 92, drive roller 94, follow roller 95 and the cleaning section 96 (not shown in FIGS. 2A and 2B). As can be seen from FIG. 2B, both ends of the rotation shaft 94A of the drive roller 94 project outward from the belt support frames 90. Specifically, the right end of the rotation shaft 94A projects rightward from the right side belt support frame 90 and the left end of the rotation shaft 94A projects leftward from the left side belt support frame 90. Similar to the rotation shaft 94A, both ends of the rotation shaft 95A of the follow roller 95 project outward from the belt support frames 90.

The inner surface of each belt support frame 90 is formed with first and second guide grooves 97 and 98 both extending rearward, i.e., in the direction in which the photosensitive drums 71 are arranged, from the frontmost end of the belt support frame 90. Stated differently, the first and second guide grooves 97, 98 extend in the lengthwise direction of the intermediate transfer belt 91. The first guide groove 97 has a U-shaped cross-section and is formed at a position lower than the intermediate transfer belt 91. The first guide groove 97 is made up of a horizontally extending portion 97A and a vertically extending portion 97B vertically extending upward from the rearmost end of the horizontally extending portion 97A, thereby forming an L-shape. The horizontally extending portion 97A extends horizontally or in the front-to-rear direction from the frontmost end of the belt support frame 90 to the portion near the rearmost end thereof. The vertically extending portion 97B is formed at the rear end of the horizontally extending portion 97A and bent upward to face the intermediate transfer belt 91.

Similar to the first guide groove 97, the second guide groove 98 has a U-shaped cross-section. The second guide groove 98 is formed at the front portion of the belt support frame 90 and below the first guide groove 97. The second guide groove 98 is also substantially of an L-shaped having a horizontally extending portion 98A and a vertically extending portion 98B. The horizontally extending portion 98A extends horizontally or in the front-to-rear direction from the frontmost end of the belt support frame 90. The horizontally extending portion 98A is not as long as the corresponding portion 97A of the first guide groove 97. The vertically extending portion 98B is formed at the rear end of the horizontally extending portion 98A and bent upward to face the intermediate transfer belt 91.

Figure 2B:
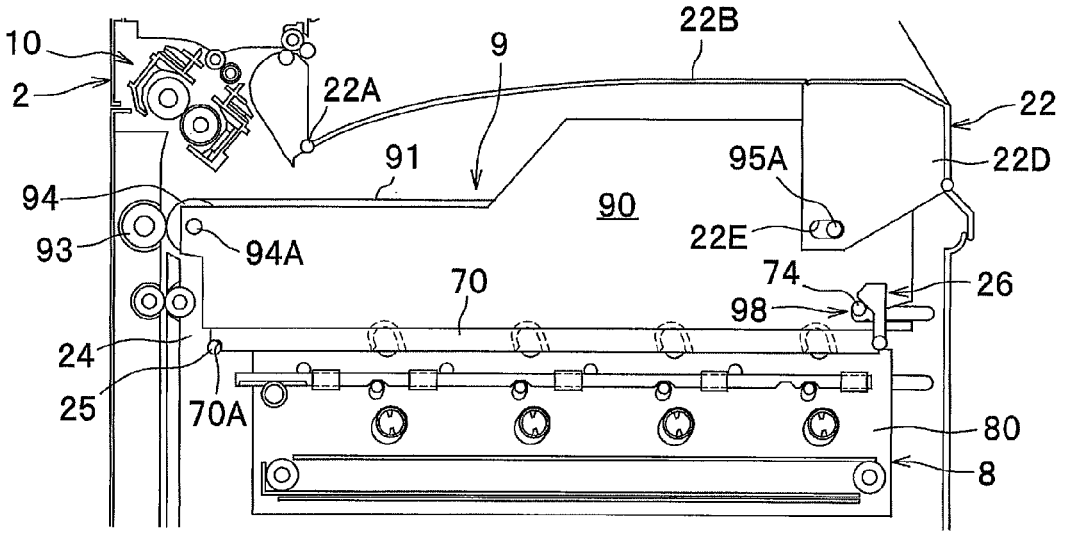
FIG. 2B shows the belt support frame supported on a body case of the color multi-function peripheral.

As shown in FIG. 2B, the belt support frames 90 are supported on the main casing 2 via the rotation shafts 94A, 95A. More specifically, an elongated hole 22E is formed in a support panel 22 attached to the front portion of the upper cover 22, and the rotation shaft 95A is penetrated into the elongated hole 22E. The belt support frames 90 (belt unit 9) is thus pivotally movable about the rear-side rotation shaft 94A in interlocking relation with the vertical movements of the upper cover 22 (see FIG. 8A).

<Configuration of Photosensitive Drum Unit>

Figure 3A:
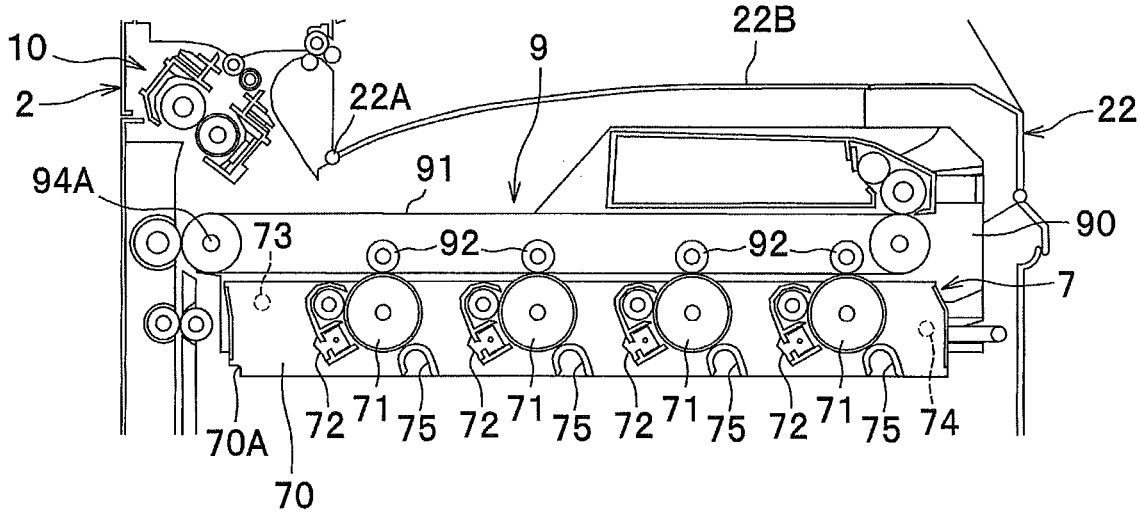
FIG. 3A is an enlarged diagram showing a structure of a photosensitive drum unit.

As shown in FIG. 3A, the photosensitive drum unit 7 includes four photosensitive drums 71 arranged in front-to-rear direction, four charging devices 72 arranged in association with the respective ones of the photosensitive drums 71 individually, and a drum support frame 70 for supporting the photosensitive drums 71 and the charging devices 72. The drum support frame 70 is configured from a pair of side plates (only a counterpart thereof is shown in FIG. 3A) disposed in confrontation with each other. The direction in which the side plates confront is in coincidence with the right-to-left direction. First support protrusion 73 projects outward from each side plate of the drum support frame 70. More specifically, one first support protrusion 73 projects leftward from the left side plate and another first support protrusion 73 projects rightward from the right side plate. Similar to the first support protrusions 73, second support protrusions 74 project outward from the side plates of the drum support frame 70, one projecting leftward from the left side plate and another projecting rightward from the right side plate.

Figure 3B:
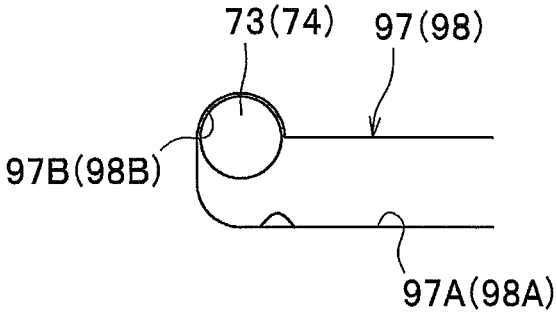
FIG. 3B is an explanatory diagram illustrating the relationship between a support protrusion and a guide groove when the photosensitive drum and an intermediate transfer belt are brought into contact with each other.

The first support protrusions 73 are provided at the rear upper portions of the drum support frame 70 and engage the first guide grooves 97 formed in the belt support frame 90. As shown in FIG. 3B, the first protrusion 73 is disposed in the upper end of the vertically extending portion 97B of the first guide groove 97 when the photosensitive drums 71 are in contact with the intermediate transfer belt 91.

The second support protrusions 74 are provided vertically centrally of the drum support frame 70 at the front portions thereof and engage the second guide grooves 98 formed in the belt support frame 90. More specifically, one second support protrusion 74 projects leftward from the left side belt support frame 90 through the second guide groove 98 and the other second support protrusion 74 project rightward from the right side belt support frame 90 through the second guide groove 98. The projected length of the second support protrusions 74 is longer than that of the first support protrusions 73. Similar to the first protrusions 73, the second protrusions 74 are disposed in the upper end of the vertically extending portions 98B of the second guide grooves 98 when the photosensitive drums 71 are in contact with the intermediate transfer belt 91.

Figure 8A:
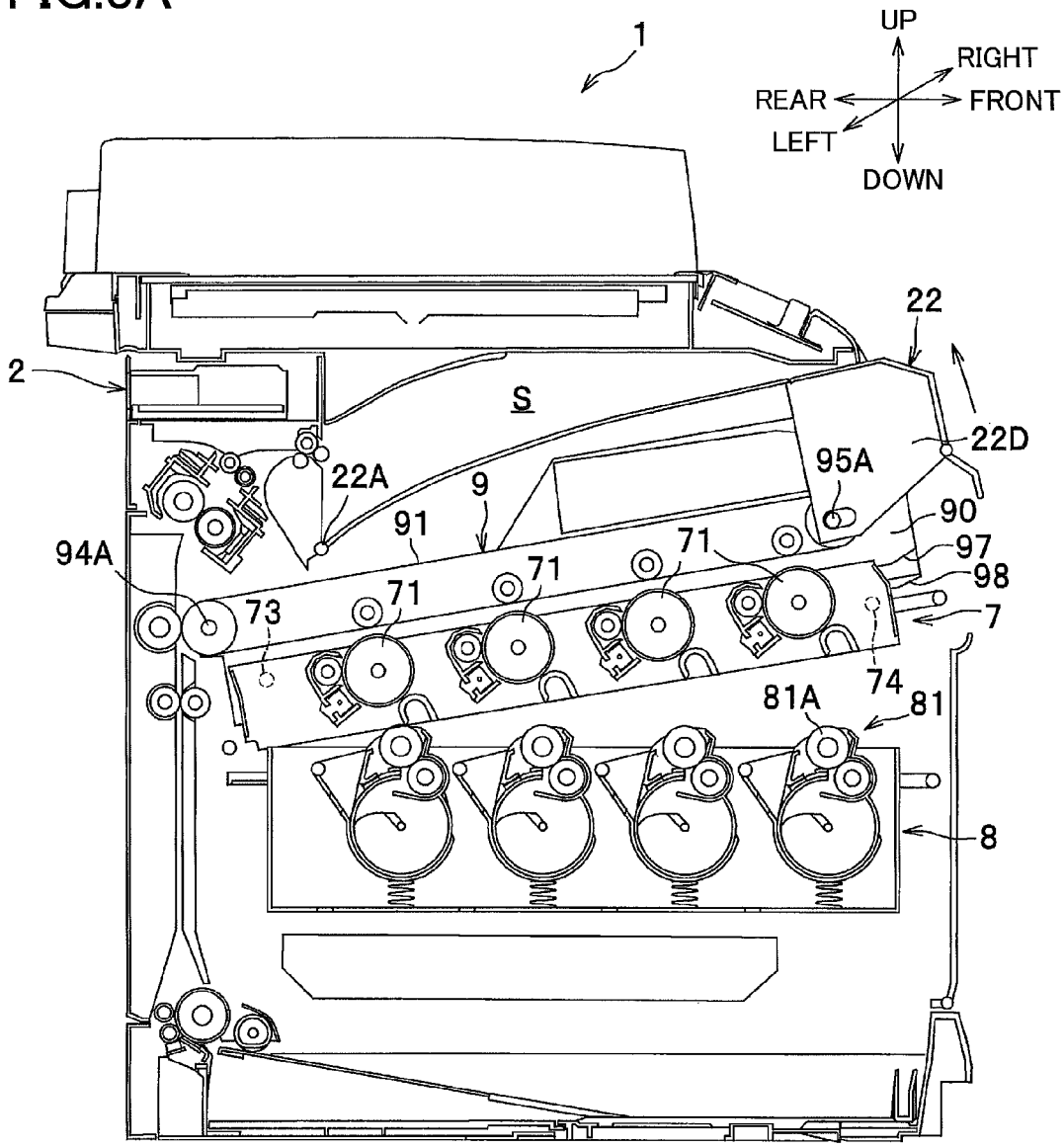
FIG. 8A is a cross-sectional view showing an upper cover pivotally moved upward.

When the first and second protrusions 73, 74 engage the first and second guide grooves 97, 98, respectively, vertical movements of the support frame 70 (photosensitive drum unit 7) relative to the belt support frame 90 (belt unit 9) are only possible in a limited range but are basically restricted. As shown in FIG. 8A, the drum support frame 70 (photosensitive drum unit 7) is vertically swingable about the rotation shaft 94A together with the belt unit 9 in interlocking relation with the vertical movements of the upper cover 22.

According to the above-described configuration, operations for moving the photosensitive drum unit 7 and the belt unit 9 can be easily performed in comparison with the case in which the photosensitive drum unit and the belt unit are individually and independently moved. Further, an arrangement for vertically swinging the photosensitive drum unit 7 and the belt unit 9 is advantageous in that the structure can be simplified and operation can be easily performed in comparison with the arrangement in which the photosensitive drum unit and the belt unit are vertically slidably moved.

Inner surface of each side plate of the drum support frame 70 is formed with four grooves 75 for guiding the movements of the photosensitive drum unit 7 and for determining the positions of the developing devices 81 relative to the corresponding photosensitive drums 71. In the rear lower portion of the drum support frame 70, an engagement concave portion 70A is formed.

Next, description will be made with respect to an arrangement for determining the position of the photosensitive drum unit 7 with respect to the main casing 2. Operation of such an arrangement will be described later.

As shown in FIG. 2B, a pair of side frames 24 (only a counterpart thereof is shown) is disposed within the main casing 2 in confronting relation with each other. The direction in which the side frames 24 confront is in coincidence with the right-to-left direction. A rod-shaped member 25 is bridged between the pair of side frames 24 at the rear lower portion of the belt support frame 90. A photosensitive drum unit urging unit 26 is provided in the front portion of each side frame 24 for urging the photosensitive drum unit 7 to maintain the same in the loaded condition.

Figure 4:
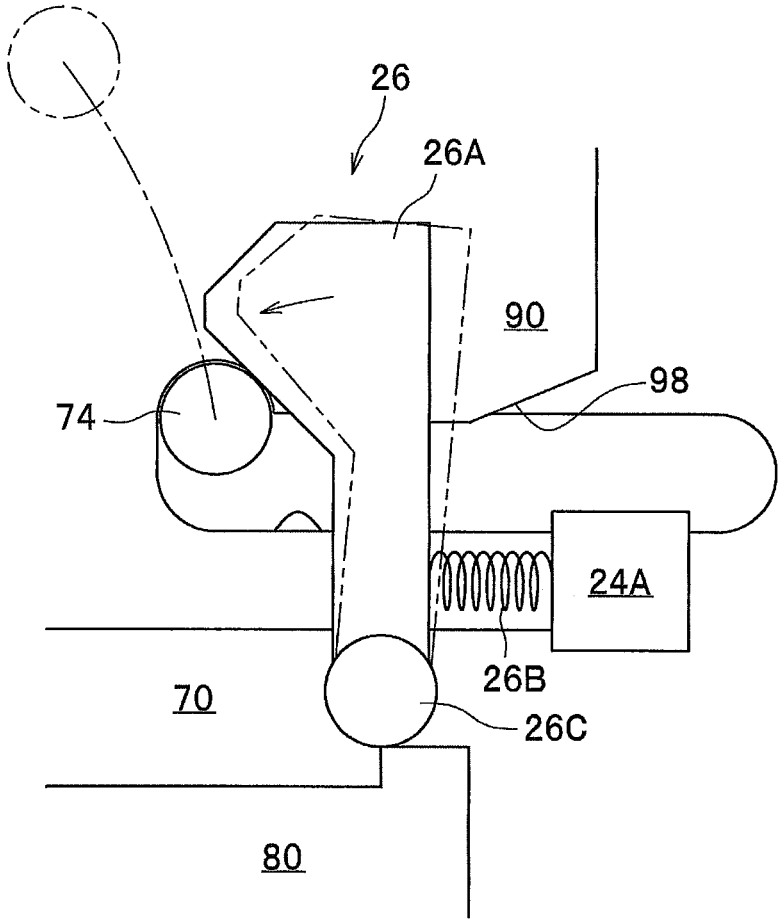
FIG. 4 is an enlarged diagram showing an urging member for urging the photosensitive drum unit.

As shown in FIG. 4 the urging unit 26 is disposed between the image forming section 5 (photosensitive drum unit 7 and belt unit 9) and the side frames 24. The urging unit 26 includes an urging arm 26A and coil spring 26B. The urging arm 26A is pivotally movable in front-to-rear direction relative to the main casing 2. A supporting shaft 26C extends in the left-to-right direction (toward forehand side in the sheet of FIG. 4) is rotatably supported on the side frames 24 (not shown in FIG. 4). Accordingly, the urging arm 26A with the lower end attached to the supporting shaft 26C is pivotally movable in the front-to-rear direction relative to the main casing 2. The coil spring 26B has one end attached to the front-side lower portion of the urging arm 26A and another end attached to the rear-side of a spring support portion 24A projecting inward in the left-to-right direction from the side frames 24.

<Configuration of Developing Device Unit>

Figure 5A:
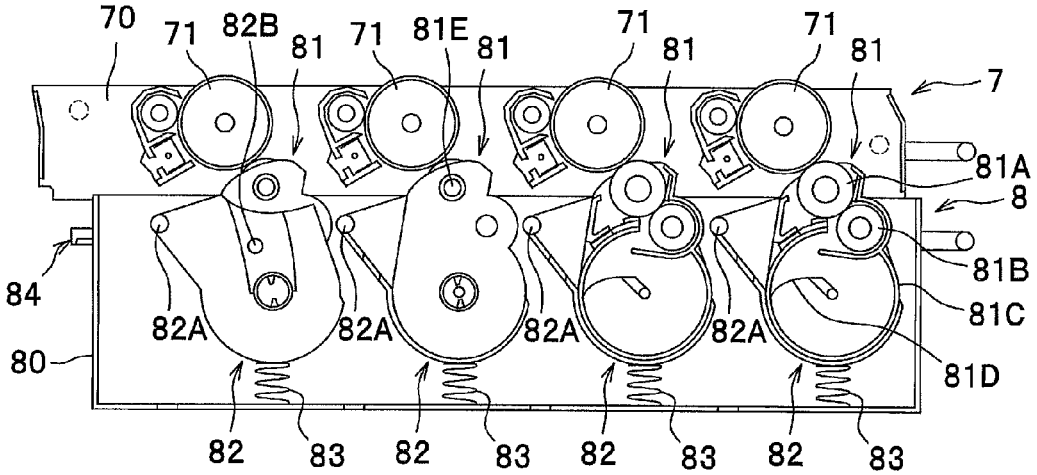
FIG. 5A shows an internal arrangement of the developing device unit when the photosensitive drums and the corresponding developing rollers are in contact with each other.
Figure 5B:
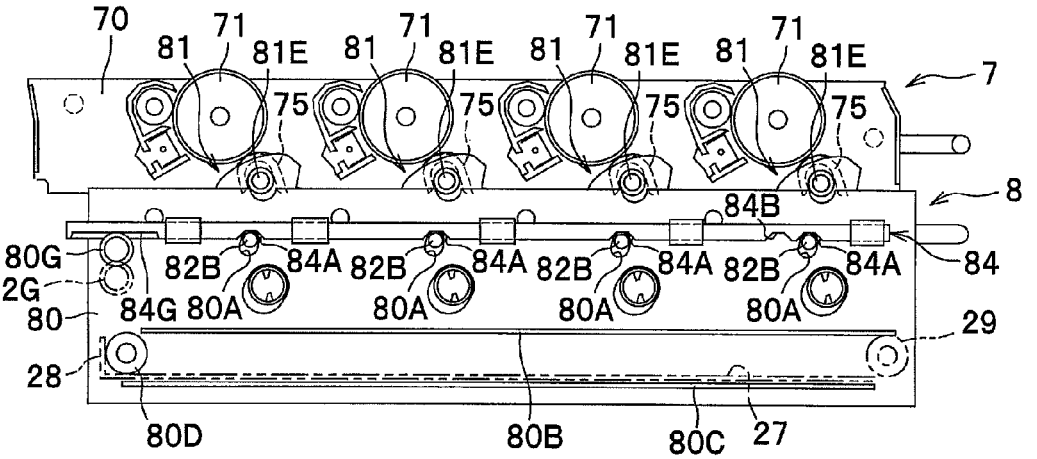
FIG. 5B shows an external arrangement of the developing device unit when the photosensitive drums and the corresponding developing rollers are in contact with each other.

As shown in FIGS. 5A and 5B, the developing device unit 8 includes a developing unit support frame 80, developing devices 81, developing device holders 82, coil springs 83 and operation bars 84.

The developing device supporting frame 80 is formed in a substantially box shape with an upper open surface. The developing device supporting frame 80 has side walls opposing to each other in the front-to-rear direction. That is, the side walls are disposed in a direction orthogonal to the axial direction of the developing rollers 81A. A plurality of through-holes 80A is formed on each side wall and each through-hole 80A has an elongated shape. A plurality of openings is formed on bottom surface of the developing device supporting frame 80 so that laser beams emitted from the exposing unit 6 can pass through the openings.

A pair of guide sections 80B and 80C is formed on outer surface of each side wall, and the guide sections 80B and 80C extend in the front-to-rear direction at the bottom portion of the side walls. A roller 80D is rotatably provided on the rear end of the guides 80B and 80C. A guide 27, a stopper 28 and a roller 29 are provided in the main casing 2. The guide 27 is provided to be positioned above the guide section 80C and extends in the front-to-rear direction along the guide section 80C. The stopper 28 is formed on the rear end of the guide 27 so as to prevent the roller 80D from moving further rearward. The roller 29 is rotatably disposed above the front end of the guide 27.

Each of the developing device holders 82 has a supporting shaft 82A. The developing device holders 82 are pivotally movably supported to the side walls of the developing device supporting frame 80 so that the developing device holders 82 are pivotally movable about the supporting shafts 82A relative to the developing device supporting frame 80. Each of the developing device holders 82 is formed with an operation portion 82B. The operation portion 82B protrudes outward in the left-to-right direction from the developing device holder 82 and penetrates into the through-hole 80A formed on the side walls of the developing device supporting frame 80. Each of the operation portions 82B is slidably movable within the through-holes 80A substantially vertically in conjunction with the pivotal movements of the developing device holder 82. A coil spring 83 is provided between the bottom surface of the developing device supporting frame 80 and a bottom end of each developing device holder 82 so that the developing device holders 82 are urged toward the respective photosensitive drums 71.

The operation bar 84 is movably provided on the outer surface of each side wall of the developing device supporting frame 80. The operation bar 84 is movable relative to the developing device supporting frame 80 in the front-to-rear direction, i.e. in a direction in which the developing rollers 81A are arranged. The operation bar 84 is formed with four first recesses 84A and a second recess 84B. The first recesses 84A are engageable with the operation portions 82B. The first recesses 84A are equally spaced apart in the front-to-rear direction to correspond to the arrangement of the operation portions 82B. The second recess 84B is designed to be engageable only with the frontmost operation portion 82B.

A rack gear section 84G is formed in the operation bar 84 at the rear bottom end thereof. A transmission gear 80G is provided on the outer surface of each of the side walls at the rear end thereof and is meshingly engaged with the rack gear section 84G. The operation bar 84 is moved in the front-to-rear direction with a driving force transmitted from the transmission gear 80G. The transmission gear 80G is also meshingly engaged with a drive gear 2G provided in the main casing 2. The drive gear 2G is driven by a control section (not shown). The transmission gear 80G follows the rotations of the drive gear 2G and transmits the driving force to the rack gear section 84G.

Here, description will be made with respect to operations for bringing the developing rollers 81A in contact with or away from the photosensitive drums.

As shown in FIGS. 5A and 5B, during color image forming operations, the operation portions 82B engage the corresponding first recesses 84A, and all of the developing device holders 82 (developing devices 81) are urged toward the corresponding photosensitive drums 71 by the coil springs 83. In this way, all developing rollers 81A are brought into contact with the corresponding photosensitive drums 71.

Figure 6A:
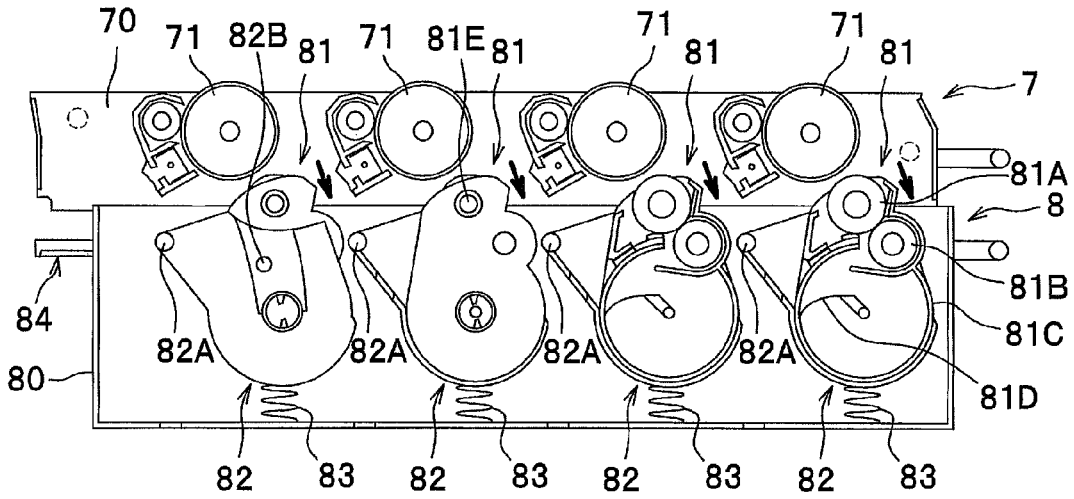
FIG. 6A shows an internal arrangement of the developing device unit when the photosensitive drums and the corresponding developing rollers are separated.
Figure 6B:
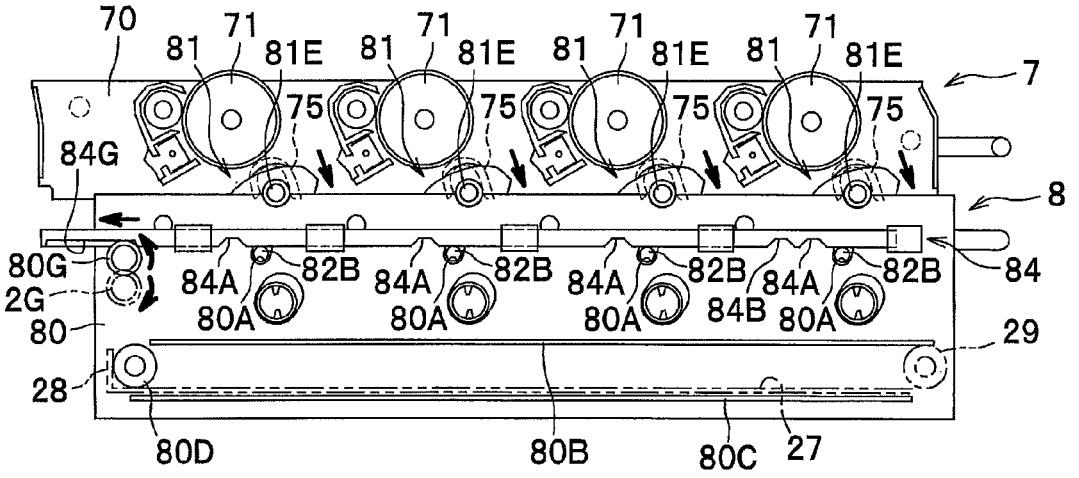
FIG. 6B shows an external arrangement of the developing device unit when the photosensitive drums and the corresponding developing rollers are separated.

When the MFP 1 is in a standby condition, or when cleaning of the photosensitive drums 71 and/or the intermediate transfer belt 91 is performed, or when replacement of the photosensitive drum unit 7 and/or developing device unit 8 is performed, the operation bar 84 is driven to move backward from the position shown in FIG. 5B by the rotations of the drive gear 2G and the transmission gear 80G. As a result, as shown in FIGS. 6A and 6B, engagement between the operation portions 82B and the corresponding first recesses 84A is released, and all the operation portions 82B are pushed downward by the operation bar 84. In this way, all developing device holders 82 (developing device 81) are also pushed downward against the urging force of the coil springs 83, and all of the developing rollers 81A are separated from the corresponding photosensitive drums 71.

All the developing rollers 81A and the photosensitive drums 71 are brought into contact with each other again if the operation portions 82B and the corresponding first recesses 84A are brought in engagement with each other with the operation bar 84 moving forward from the position shown in FIG. 6B by the rotations of the drive gear 2G and the transmission gear 80G.

Figure 7:
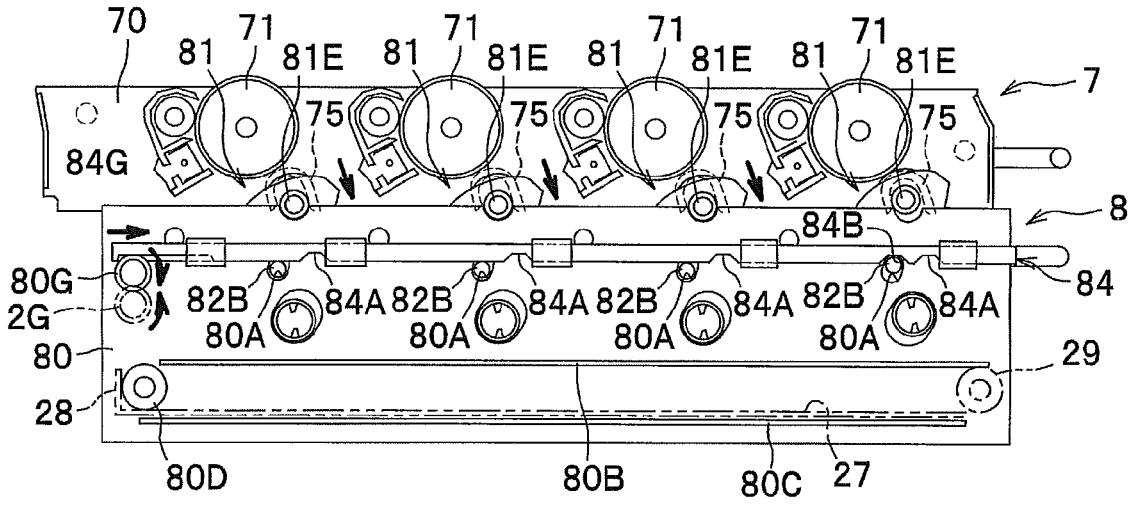
FIG. 7 is an external arrangement of the developing device when the frontmost photosensitive drum and the corresponding developer roller are in contact with each other.

When the drive gear 2G and the transmission gear 80G rotate and drive the operation bar 84 to move forward from the position shown in FIG. 5B, all the operation portions 82B are disengaged from the corresponding first recesses 84A as shown in FIG. 7, but only the frontmost operation portion 82B engages the second recess 84B. At this time, only the frontmost developing roller 81A is brought in contact with the corresponding photosensitive drum 71 thereby enabling to perform image forming operations with the combination of the frontmost developing device 81 and the frontmost photosensitive drum 71. The remaining three developing rollers 81A are pushed downward by the operation bar 84 against the urging fore of the coil springs 83 and thus separated from the corresponding photosensitive drums 71. In this way, the MFP 1 can perform monochromic printing in this state.

In the present embodiment, positions of the developing devices 81 can be easily changed by the movements of the operation bar 84. The developing rollers 81A and the photosensitive drums 71 are thus easily brought into contact with or away from each other.

Positions of the developing devices 81 are changed via respective developing device holders 82, so that rigidity of the developing device supporting frame 80 is improved. More specifically, if the developing devices themselves are formed with the operation portions protruding outward from the side walls of the developing device supporting frame, grooves are necessary to be formed on each side wall from the upper end thereof to extend substantially downward for detachment of the developing devices. The above-described configuration according to the present embodiment achieves higher rigidity than the latter case because each side wall of the developing device supporting frame 80 is formed with the though-holes 80A rather than the grooves.

Note that, in the color MFP 1 according to the present embodiment, the developing rollers 81A and the photosensitive drums 71 are controlled to be separated from each other except when the developing rollers 81A supplies toner to the photosensitive drums 71 during image forming operations, for example. Also note that, the operations described above are controlled to be executed when the photosensitive drum unit 7 and the developing device unit 7 are mounted in the main casing 2 and the upper cover 22 is closed.

<Operation of Color MFP>

Replacing operation of the photosensitive drum unit 7 and/or the developer device unit 8 in the color MFP 1 as arranged above will be described with reference to FIGS. 8A, 8B, 9 and 10.

As shown in FIG. 8A, moving the upper cover 22 upward causes both the belt unit 9 and the photosensitive drum unit 7 to pivotally move upward about the rotation shaft 94A. As a result, the belt unit 9 and the photosensitive drum unit 7 are separated from the developing device unit 8.

Figure 8B:
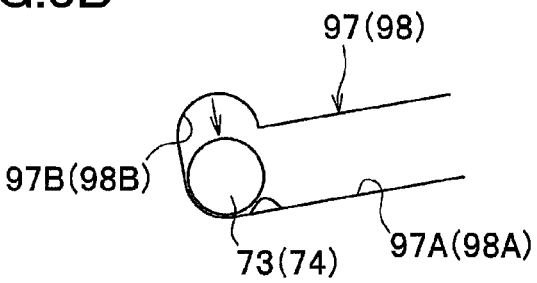
FIG. 8B shows the support protrusion moving along a vertically extending groove.

At this time, the support protrusions 73, 74 move downward as shown in FIG. 8B along the vertically extending portions 97B, 98B of the first and second guide grooves 97, 98 and reach the rearmost ends of the horizontally extending portions 97A, 98A. By this downward movements of the support protrusions 73, 74, the overall photosensitive drum unit 7 moves downward, thereby separating the photosensitive drums 71 from the intermediate transfer belt 91 as shown in FIG. 8A.

When the belt unit 9 is pivotally moved upward to be separated from the developing device unit 8, the front portion of the belt unit 9 moves into space S. Stated differently, the belt unit 9 is configured so that its movement is stopped in the space S. As such, moving distances of the belt unit 9 and the photosensitive drum unit 7 are small, so that operations for pivotally moving the belt unit 9 and the photosensitive drum unit 7 can readily be performed. Besides, the belt unit 9 and the photosensitive drum unit 7 can be made compact. Additionally, there is no need to move or retract the flat head scanner 3 when the belt unit 9 and the photosensitive drum unit 7 are pivotally moved, so that the structures of the main casing 2 and the flat head scanner 3 can be made simple.

Figure 9:
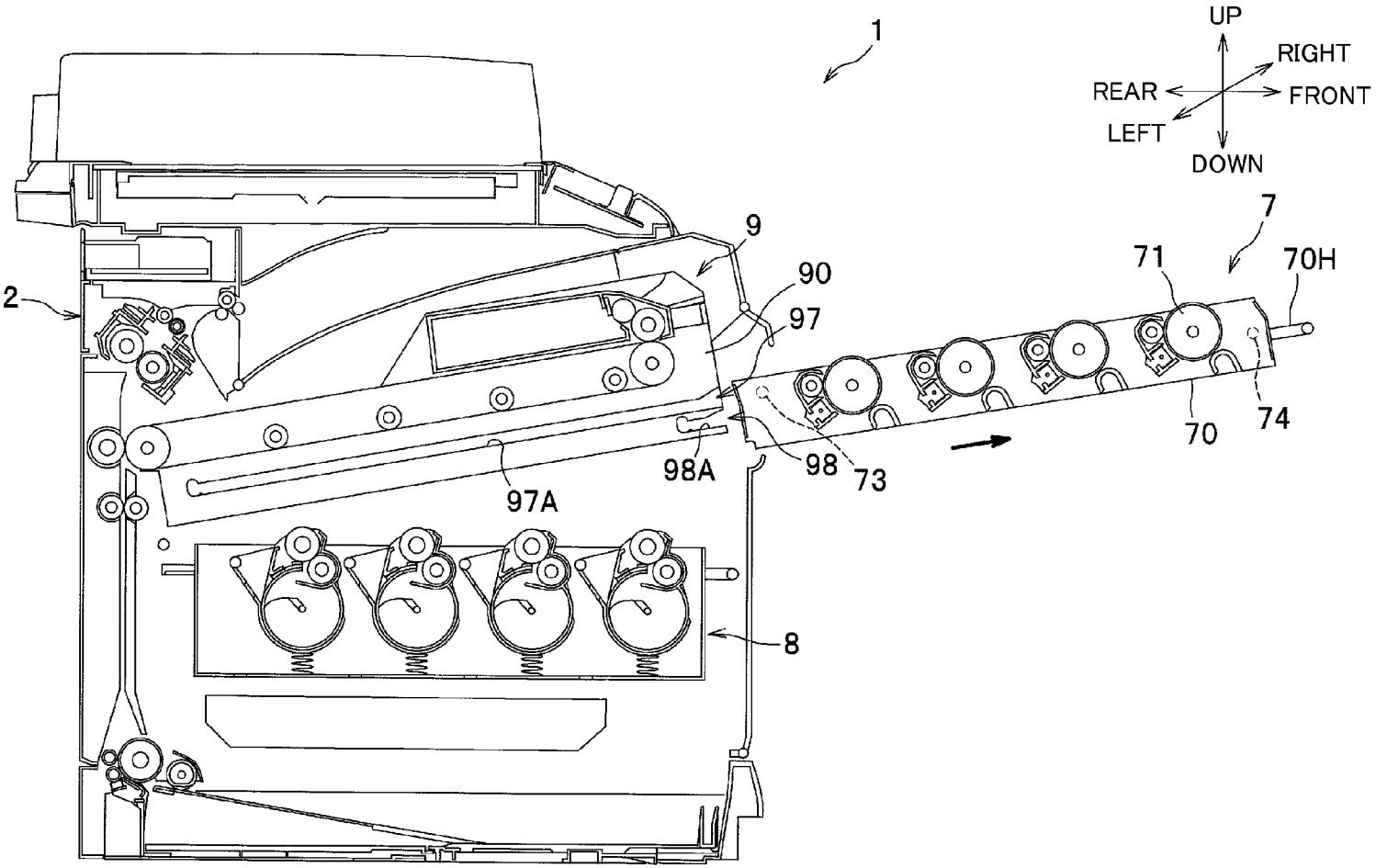
FIG. 9 is a cross-sectional view of the color multi-function peripheral showing a state in which the photosensitive unit is drawn outward.

As shown in FIG. 9, when the photosensitive drum unit 7 is replaced with a new one, the handle 70H provided at the frontmost end of the drum supporting frame is drawn frontward to move the respective support protrusions 73, 74 along the corresponding horizontally extending portions 97A, 98A of the first and second guide grooves 97, 98. Then, the photosensitive drum unit 7 can be easily removed or drawn out from the main casing 2 along the direction in which the photosensitive drums 71 are arranged. Afterwards, a new photosensitive drum unit 7 can be mounted in the main casing 2 through the reverse operation.

As described above, the color MFP 1 according to the embodiment of the invention, separation of the intermediate transfer belt 91 and the photosensitive drums 71 can be achieved by separating both the belt unit 9 and the photosensitive drum unit 7 from the developing device unit 8 by pivotally moving the belt unit 9 and the photosensitive drum unit 7 upward, therefore, the photosensitive drum unit 9 including a plurality of photosensitive drums 71 can be extracted from the main casing 2. Replacement of the photosensitive drums 71 can be achieved only by upwardly pivotally moving the belt unit 9 and the photosensitive drum unit 7. Hence, operability in the case of replacement of the photosensitive drum is greatly improved.

Figure 10:
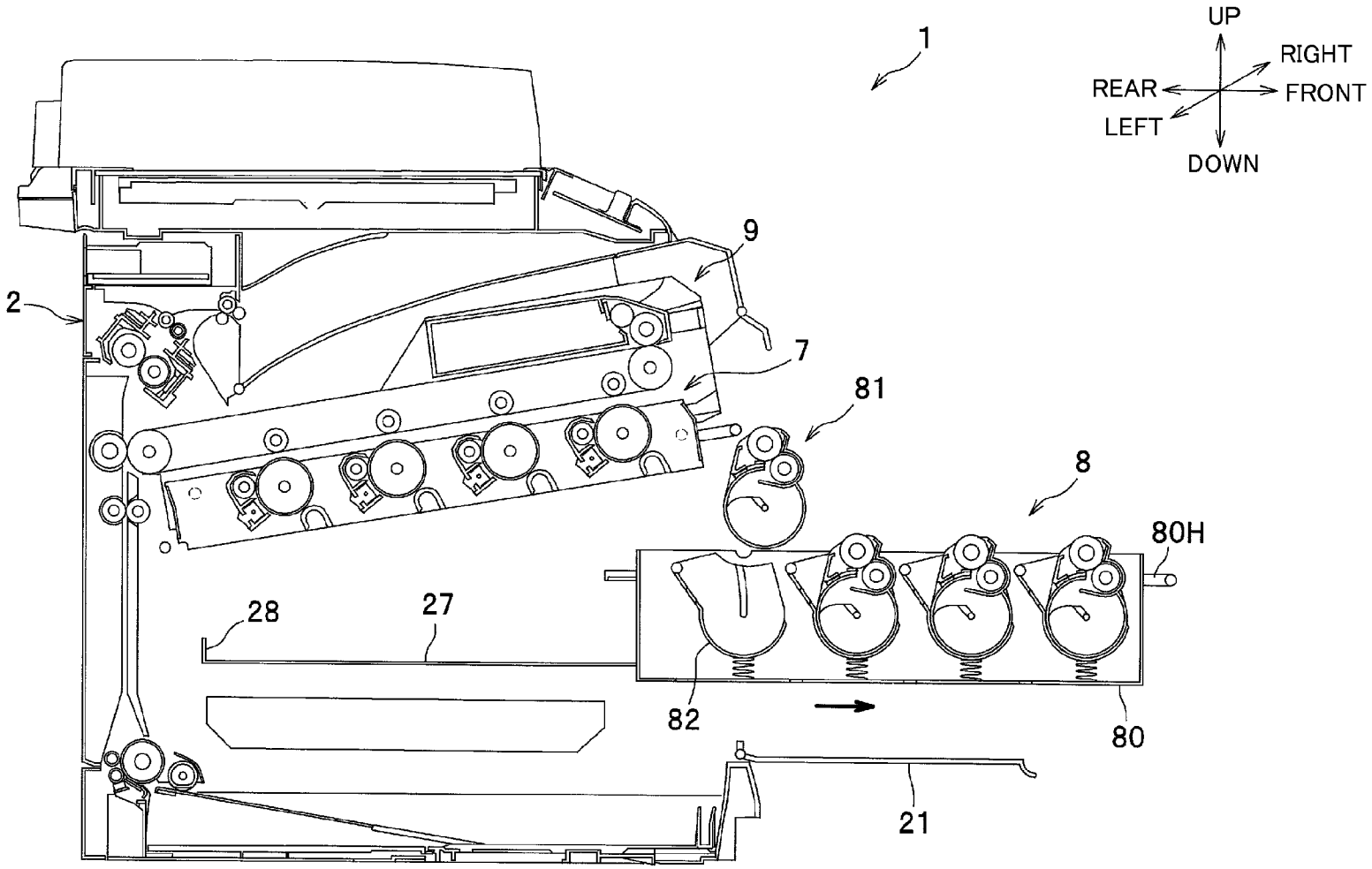
FIG. 10 is a cross-sectional view of the color multi-function peripheral showing a state in which the developing device unit is drawn outward.

In order to replace any one or all of the developing devices mounted on the developing device unit 8 with a new one, the front cover 21 is firstly moved frontward, and subsequently the handle 80H provided at the frontmost end of the developing device supporting frame 80 is drawn frontward, as shown in FIG. 10. Drawing the handle 80H frontward causes the roller 80D to move along the guide section 27. While the roller 29 is being moved by the guide section 80B, the developing device supporting frame 80 moves in the direction in which the developing rollers 81A are arranged, thus the developing device unit 8 can be retracted from the main casing 2. The developing device 81 subject to replacement is dismounted from the developing device holder and a new developing device 81 is mounted thereon. Afterwards, the developing device support holder 80 is pushed rearward to mount the developing device unit 8 in the main casing 2.

Next, description will be made with respect to positioning of the photosensitive drums 71 with the corresponding developing devices 81. After the photosensitive drum 71 and/or the developing device 81 is replaced with a new one and both the photosensitive drum unit 7 and the developing device unit 8 are mounted in the main casing 2, the front cover 21 is closed and then the upper cover 22 is moved downward. Through those operations, both the belt unit 9 and the photosensitive drum unit 7 pivotally move downward about the rotation shaft 94A to move to positions close to the developing device unit 8 (see FIG. 6).

At this time, as shown in FIG. 6B, the rotation shaft 81E of the developing roller 81A extending outward (leftward and rightward) from the frame of the developing device 81 is brought into engagement with the groove section 75 of the photosensitive drum unit 7. This engagement can determine the position of the developing device 81 with respect to the corresponding photosensitive drum 71. It should be noted that the groove section 75 also serves as a guide for guiding the movements of the photosensitive drum unit 7 per se.

As shown in FIG. 2B, the drum supporting frame 70 is brought into abutment with the bar-shaped member 25. More specifically, the concave portion 70A formed in the drum supporting frame 70 engages the bar-shaped member 25, enabling positioning of the drum supporting frame 70 with respect to the main casing 2 which in turn enables the positioning of the photosensitive drum 71 supported on the drum supporting frame 70.

Further, as shown in FIG. 4, the second support protrusions 74, which are formed in the drum supporting frame 70, and penetrate into the second guide groove 98 formed in the belt supporting frame 90 and project outward (rightward and leftward) from the belt supporting frame 90, are urged rearward by the urging arm 26A and the coil spring 26B. In this manner, the drum supporting frame 70 is urged against the bar-shaped member 25, so that the photosensitive drum 71 (drum supporting frame 70) can be accurately positioned with respect to the main casing 2.

Although the present invention has been described with respect to specific embodiments, it will be appreciated by one skilled in the art that a variety of changes may be made without departing from the scope of the invention.

For example, the above-described embodiment shows the intermediate transfer belt 91 as one example of belts, the belt to which the present invention is applied is not limited to the intermediate transfer belt but the present invention is applicable to any other types of belts such as a paper conveying belt.

In the above-described embodiment, an arrangement for moving the photosensitive drum 71 toward and away from the intermediate transfer belt 91 is such that the vertically extending portions 97B, 98B are continuously formed to the ends of the guide grooves 97, 98 for moving the support protrusions 73, 74 therealong. However, the present invention is not limited to such an arrangement. Under the condition in which the belt unit and the photosensitive drum unit are separated from the developing device unit, separation of the photosensitive drum from the belt unit can be achieved by changing the moving distances or pivotal angles of the belt unit and the photosensitive drum unit.

The above-described embodiment shows an example in which the bar-shaped member 25 is provided at the rear side of the photosensitive drum unit 7. However, the present invention is not limited to such an example. The bar-shaped member 25 may be provided in the front side or centrally of the photosensitive drum unit 7. Further, various types of well-known arrangements can be employed in lieu of the bar-shaped member for positioning the photosensitive drum 71.

When the bar-shaped member is provided in the front side of the photosensitive drum unit 7, it is desirable that the urging member for urging the photosensitive drum unit be provided at the rear side relative to the bar-shaped member. For the arrangement in which the bar-shaped member is provided centrally of the photosensitive drum unit and the bar-shaped members engage concave portions formed in the lower part of the drum supporting frame, it is desirable that the direction in which the photosensitive drum unit is urged be appropriately determined depending upon the position in which the urging member for urging the photosensitive drum unit is provided.

The above-described embodiment shows an example in which the two guide grooves 97, 98 are formed in the two belt supporting frames 90, respectively. However, the present invention is not limited to such an example. For example, the number of guide grooves may either be one or three. In such cases, the number of support protrusions formed in the drum supporting frames has to be determined depending upon the number of guide grooves in due course.

The above-described embodiment shows an example in which the guide grooves 97, 98 are formed in the belt supporting frames 90 and support protrusions 73, 74 are formed in the drum supporting frames 70. However, the present invention is not limited to such example. For example, an arrangement for drawing the photosensitive drum unit from the main casing 2 may be such that the support protrusions are formed in the supporting frames, and the guide grooves in the drum supporting frames.

In the above embodiment, the first recesses 84A and the second recess 84B are formed on the operation bar 84 and each is designed to be engageable with respective ones of the operation portions 82B. In accordance with movements of the operation bar 84, the developing rollers 81A and the photosensitive drums 71 are brought in close to each other when the operation portions 82B are engaged with the first recesses 84A and the second recess 84B, while the developing rollers 81A and the photosensitive drums 71 are in separation to each other when the operation portions 82B are disengaged from the first recesses 84A and the second 84B. However, the present invention is not limited to the above described embodiment. For example, protrusions may be formed on the bottom surface of the operation bar. In this case, in accordance with the movements of the operation bar, the developing rollers and the photosensitive drums are designed to be distanced from each other when the protrusions push the operation portions downward, while the developing rollers and the photosensitive drums are designed to be close to each other when the operation portions are disengaged from the protrusions in conjunction with the urging force of the urging members. Note that, in this case, as long as the color MFP can perform printing, the developing rollers may not necessarily be in direct contact with the photosensitive drums, but may be disposed in a position slightly distanced from the photosensitive drums.

The developing device holder 82 is pivotally supported to the developing device supporting frame 80 in the above-described embodiment. However, as a variation, the developing devices may be configured to be slidably movable relative to the developing device supporting frame 80. Alternatively, the developing device unit may have such a configuration that the developing devices are directly supported to the supporting frame without employing developing device holders.

The coil springs 83 are employed as an urging member to urge the developing device holders 82 in the above-described embodiment, but leaf springs or extension springs may be used instead of the coil springs 83. The photosensitive drum unit 7 and the developing device unit 8 are designed to be pulled out from the front side of the main body 2 in the front-to-rear direction in the above-described embodiment. However, the photosensitive drum unit 7 and the developing device unit 8 may be configured to be taken out from either left or right side of the main body 2 of the MFP 1.

The color MFP is described as an example of image forming devices according to an embodiment of the present invention. This invention can be applied to a copier, and also to a printer that is not provided with a flat head scanner (an image scanning unit). Although the exposing unit 6 employs a laser as a light source in the above-described embodiment, a light emitted from LEDs, electroluminescence elements and florescent materials may also be employed to expose the photosensitive drums 71 to light.

In the above described embodiment, a contact development type image forming device is described in which toner borne on the surfaces of the developing rollers 81A is supplied to the surfaces of the photosensitive drums 71 when the developing rollers 81A and the photosensitive drums 71 are in contact with each other. However, the present invention is not limited to the above embodiment. The present invention may be applied to a non-contact type image forming device in which developer borne on developing rollers is supplied to photosensitive drums when the photosensitive drums and the developing rollers are close to, but not in direct contact with each other.

What is claimed is:

1. An image forming apparatus comprising:

a main casing;

an endless belt;

a plurality of transfer members;

a plurality of photosensitive drums arranged along the endless belt and disposed corresponding to the plurality of transfer members, electrostatic latent images being formable on each photosensitive drum;

a plurality of developing devices disposed in one-to-one correspondence with the plurality of photosensitive drums, each developing device including:

a developing roller configured to supply toner to a corresponding one of the plurality of photosensitive drums to develop the electrostatic latent images formed thereon; and a toner accommodating chamber disposed below the developing roller and configured to accommodate toner therein;

a holder unit configured to hold the plurality of developing devices and to be movable relative to the main casing; and a pivot mechanism having a plurality of pivot shafts each of which is disposed below both the endless belt and a corresponding one of the plurality of photosensitive drums, the pivot mechanism being configured to pivot each of the plurality of developing devices relative to the corresponding one of the plurality of photosensitive drums about a corresponding one of the plurality of pivot shafts.

2. The image forming apparatus according to claim 1, wherein the holder unit is configured to be movable in a direction perpendicular to rotation axes of the plurality of photosensitive drums.

3. The image forming apparatus according to claim 1, wherein each of the pivot shafts is disposed at a position apart from a nip position, where the corresponding one of the plurality of photosensitive drums and the developing roller of the corresponding one of the plurality of developing devices contact each other, in a normal direction of a circumferential surface of the corresponding one of the plurality of photosensitive drums.

4. The image forming apparatus according to claim 1, wherein the pivot mechanism further includes a plurality of springs each of which is configured to urge the corresponding one of the plurality of developing devices toward the corresponding one of the plurality of photosensitive drums.

5. The image forming apparatus according to claim 1, wherein the pivot mechanism further includes an operation member configured to pivot the plurality of developing devices.

6. The image forming apparatus according to claim 1, wherein the holder unit comprises a plurality of holders each of which is configured to hold a corresponding one of the plurality of developing devices.

7. The image forming apparatus according to claim 6, wherein each of the plurality of holders is pivotable about a corresponding one of the plurality of pivot shafts.

8. The image forming apparatus according to claim 1, wherein the pivot mechanism is mounted on the holder unit.

9. The image forming apparatus according to claim 1, wherein the developing roller is disposed below a corresponding one of the plurality of photosensitive drums.

10. The image forming apparatus according to claim 1, wherein the holder unit is configured to be movable relative to the plurality of photosensitive drums.

11. The image forming apparatus according to claim 1, further comprising an exposing unit disposed below the holder unit.

12. The image forming apparatus according to claim 11, wherein the exposing unit includes a laser beam source.

* * * * *